United States Patent [19]

Uesawa et al.

[11] Patent Number: 5,021,713

[45] Date of Patent: Jun. 4, 1991

[54] MAGNETRON

[75] Inventors: Kaoru Uesawa; Yoshio Abe, both of Utsunomiya, Japan

[73] Assignee: Matsushita Electronics Corporation, Kadoma, Japan

[21] Appl. No.: 338,022

[22] Filed: Apr. 14, 1989

[30] Foreign Application Priority Data

| | | | |
|---|---|---|---|
| Apr. 25, 1988 | [JP] | Japan | 63-102133 |
| Apr. 27, 1988 | [JP] | Japan | 63-104563 |
| May 17, 1988 | [JP] | Japan | 63-119596 |

[51] Int. Cl.[5] ..... H01J 25/50

[52] U.S. Cl. ..... 315/39.51; 315/39.53; 331/86

[58] Field of Search ..... 315/39.51, 39.53, 39.55, 315/39.59, 39.65, 39.67, 39.69, 39.71, 39.75, 39.77, 85; 331/86, 87, 88; 313/153

[56] References Cited

U.S. PATENT DOCUMENTS

| | | | |
|---|---|---|---|
| 3,087,089 | 4/1963 | Niclas | 315/39.3 |
| 3,634,790 | 1/1972 | Turteltaub | 333/83 A |
| 3,849,737 | 11/1974 | Oguro | 331/86 |
| 4,705,989 | 11/1987 | Takada et al. | 315/39.51 |
| 4,833,367 | 5/1989 | Harada | 315/39.53 |
| 4,855,645 | 8/1989 | Kinuno et al. | 315/39.51 |

FOREIGN PATENT DOCUMENTS

| | | | |
|---|---|---|---|
| 0187033 | 7/1986 | European Pat. Off. . | |
| 0205316 | 12/1986 | European Pat. Off. | 315/39.51 |
| 0339374 | 11/1989 | European Pat. Off. | 315/39.51 |
| 2276685 | 1/1976 | France . | |
| 52-55967 | 12/1977 | Japan . | |
| 0288347 | 12/1986 | Japan | 315/39.51 |
| 0122028 | 6/1987 | Japan | 315/39.51 |
| 0605253 | 7/1948 | United Kingdom . | |
| 1508326 | 4/1978 | United Kingdom . | |

*Primary Examiner*—Eugene R. LaRoche
*Assistant Examiner*—Ali Neyzari
*Attorney, Agent, or Firm*—Panitch Schwarze Jacobs & Nadel

[57] ABSTRACT

A magnetron in which a choke for preventing leakage of harmonic components of leaking microwaves to the outside of the tube is formed by a metal piece with slots that is placed within the tube or a conductive film that is placed on an insulating area of the stem.

9 Claims, 8 Drawing Sheets

MAGNETRON

BACKGROUND OF THE INVENTION

1. Field of the Invention

This invention relates to a magnetron for use in microwave heating apparatuses of microwave ovens and the like.

2. Description of the Prior Art

FIG. 19 shows a conventional magnetron used in microwave ovens and the like. The anode cylinder 1 has a number of anode vanes 3 arranged on its interior surface. These anode vanes 3 project toward the cathode 2, forming a resonant cavity. At either opening of the two ends of the anode cylinder 1, a pair of funnel-shaped magnetic pole pieces, first and second magnetic pole pieces 4 and 5, for the converging of the magnetic field are arranged so as to face each other. Flange 8*a* of the eyelet-shaped metal tube 8 that seals a metal sleeve 6 by means of a ceramic insulating tube 7 covers the first magnetic pole piece 4 so as to seal the opening at one end of the anode cylinder 1. The microwave output conductor 9 that extends from the anode vanes 3 connects to the metal sleeve 6. The cap-shaped microwave output metal terminal 10 is fit over the metal sleeve 6.

On the other end, a pair of cathode supporting bars 11 and 12 pass in an air-tight fashion through a cup-shaped ceramic stem insulator 13, which seals the eyelet-shaped metal tube 14 at that end. Flange 14*a* of the metal tube 14 covers the second magnetic pole piece 5 so as to seal the opening at the other end of anode cylinder 1. The stem insulator 13 and the pair of cathode supporting bars 11 and 12 are sealed so as to be air-tight by a pair of terminals 15 and 16 provided on the outside surface of the bottom of the stem insulator 13.

Usually, this kind of magnetron has a microwave oscillating function with a fundamental wave of 2450 MHz, and output is picked up through the microwave output terminal 10. However, there is danger of leakage of microwaves to the outside of the tube through the stem insulator 13 the propagation path of the cathode supporting bars 11 and 12.

By connection of an LC filter circuit to the cathode terminals 15 and 16, and by the encasing of this circuit and the stem insulator 13 in a metal shielding case, the leakage of microwaves to the outside of the apparatus is prevented. However, with this kind of construction, a relatively large shielding case and a high potential resisting feed-through-type capacitor are needed, so that miniaturization of the apparatus and lowering of costs become difficult.

As disclosed in Japanese Utility Model Publication No. 52-55967, it is possible to provide a variety of cylindrical choke elements to prevent the propagation of harmonic components through the microwave leakage propagation route that passes from the resonant cavity to the stem insulator through the cathode supporting bars. However, if a number of cylindrical choke elements are provided inside the tube, it is difficult to achieve miniaturization of the magnetron and lowering of costs of the magnetron.

SUMMARY OF THE INVENTION

The magnetron of this invention, which overcomes the above-discussed and numerous other disadvantages and deficiencies of the prior art, comprises an anode cylinder, a cathode that is disposed within said anode cylinder, a pair of magnetic pole pieces that are disposed one each over the openings of both ends of said anode cylinder, a stem insulator that seals the opening of one end of said anode cylinder so as to cover said magnetic pole piece at the opening of the end of said anode cylinder with an metal tube, and a pair of cathode supporting bars that pass through said stem insulator in an air-tight fashion, wherein said metal tube is provided with a circular metal piece surrounding said cathode supporting around said metal piece is provided with a slot for the decay or reflection of fundamental components or any of the harmonic components of oscillating microwaves.

In a preferred embodiment, the slot has an electrical length that corresponds to about $\frac{1}{2}$ or about $\frac{3}{4}$ of the wavelength of said fundamental components or any of the harmonic components of oscillating microwaves.

In a preferred embodiment, the edge of said metal piece is held between said magnetic pole piece and said metal tube.

In a preferred embodiment, the metal piece is an eyelet-shaped metal piece, the flange of which is provided with said slot.

In a preferred embodiment, the metal piece is an eyelet-shaped metal piece, the cylindrical portion of which is provided with said slot.

With this construction, the metal piece forms a choke of the microstrop-line type (that is, the microwave components that would leak toward the stem insulator the propagation path of the cathode supporting bars decay or are reflected by resonance at the slot of the metal piece), resulting in a decrease in the leakage of microwaves to the outside of the tube, so that it is possible to eliminate completely or to miniaturize the LC filter circuit and the shielding case.

Another magnetron of this invention comprises an anode cylinder, a cathode that is disposed within said anode cylinder, a metal sleeve that seals the opening of one end of said anode cylinder by means of a metal tube and an insulating tube, and a microwave output conductor that extends from anode vanes that project toward said cathode from the inside surface of said anode cylinder, said microwave output conductor being connected to said metal sleeve, wherein said metal tube is provided with a circular metal piece that surrounds said microwave output conductor and said metal piece is provided with a slot in which any of the harmonic components of oscillating microwaves resonate.

In a preferred embodiment, the slot has an electrical length that corresponds to about $\frac{1}{4}$ or $\frac{1}{2}$ of the wavelength of any of said harmonic components.

In a preferred embodiment, the slot is formed into an arc of the circle along the circumference of said disc-shaped metal plate.

In a preferred embodiment, the slot is constituted by a plurality of arc-shaped slots that have different electrical lengths.

In a preferred embodiment, the metal piece is incorporated with said metal tube into one piece.

With this construction, the metal plate forms a check of the microstrip-line type(that is, the harmonic components that are radiated to the outside of the tube the propagation path of the microwave output conductor decay or are reflected by resonance at the slot of the metal piece), so the amount of the said harmonic components that are radiated outside of the tube can be decreased.

Another magnetron of this invention comprises an anode cylinder, a cathode that is disposed within said anode cylinder, a pair of cathode supporting bars, and a stem insulator that seals the opening of one end of said anode cylinder by means of a metal tube, said stem insulator having a disc-shaped portion through which said cathode supporting bars pass and said disc-shaped portion of said stem insulator having a circular conductive film that seals the space between the circular portion of said stem insulator and said metal tube, wherein a conductive film is disposed on said disc-shaped portion of said stem insulator, resulting in a choke at which the fundamental components or any of the harmonic components of oscillating microwaves resonate, and said conductive film is connected to said cathode supporting bars.

With this construction, the choke that is formed by the conductive film resonates together with at least some of the microwaves that leak toward the stem insulator the cathode supporting bars as a propagation path, so that it is possible to cause decay of the microwaves that leak to the outside of the tube. Moreover, because the choke is formed by the conductive film, the spacers needed therefore can be made smaller. Also, because the reflected microwaves are immediately taken into the said metal tube, there is no need for the conventional large shielding case.

Thus, the invention described herein makes possible the objective of providing a magnetron with which miniaturization and lowering of costs can be attained although there are choke elements inside the tube to prevent the leakage of microwaves.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
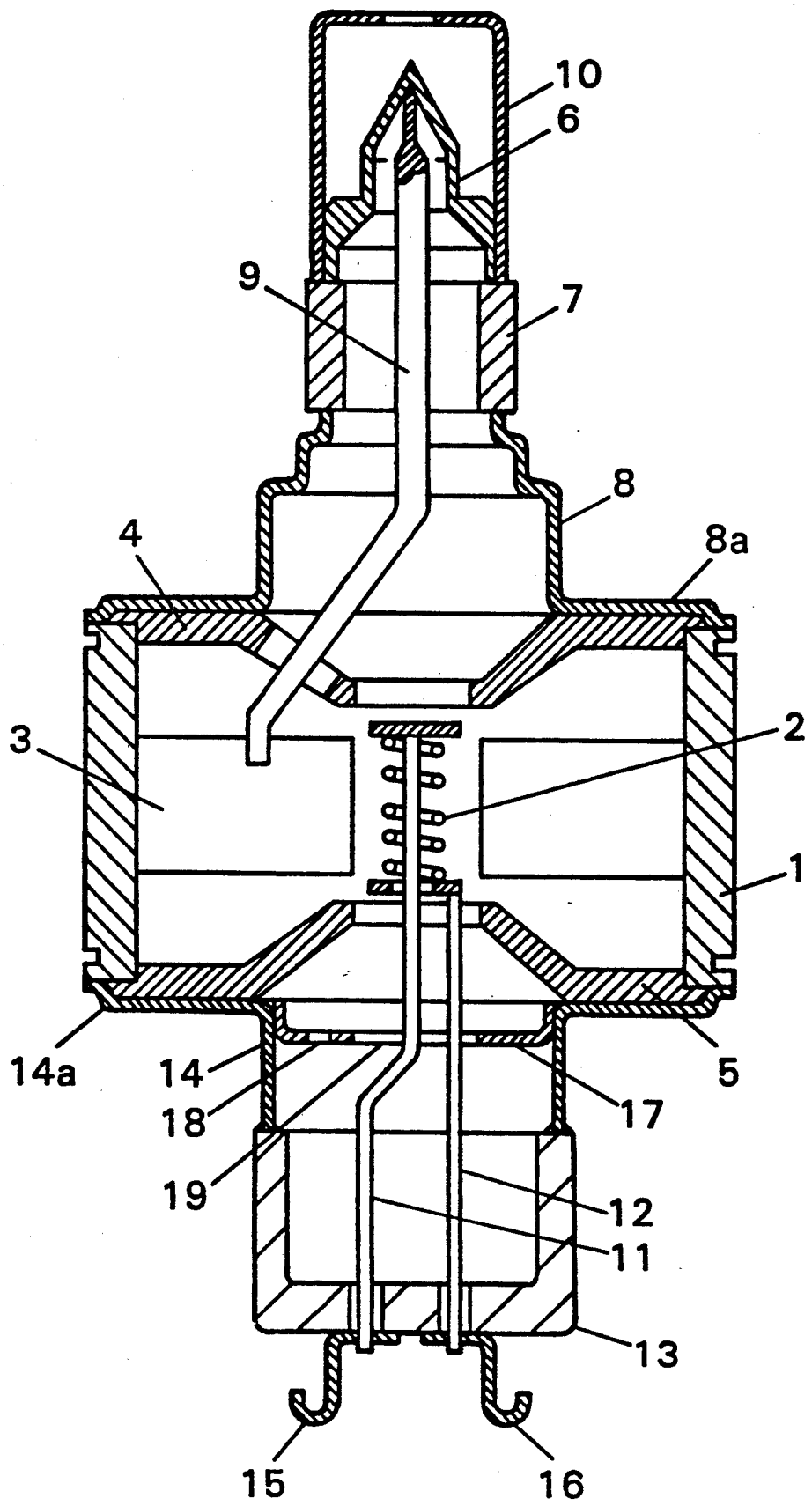
FIG. 1 is a sectional side view showing a magnetron of this invention.
Figure 2:
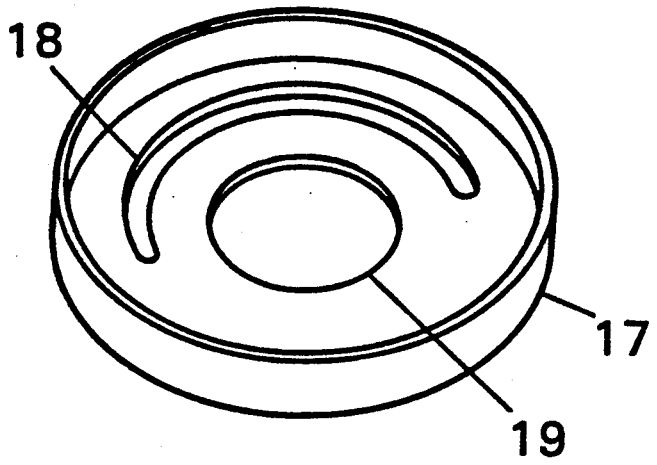
FIG. 2 is a perspective view showing a circular metal piece of the magnetron shown in FIG. 1.
Figure 19:
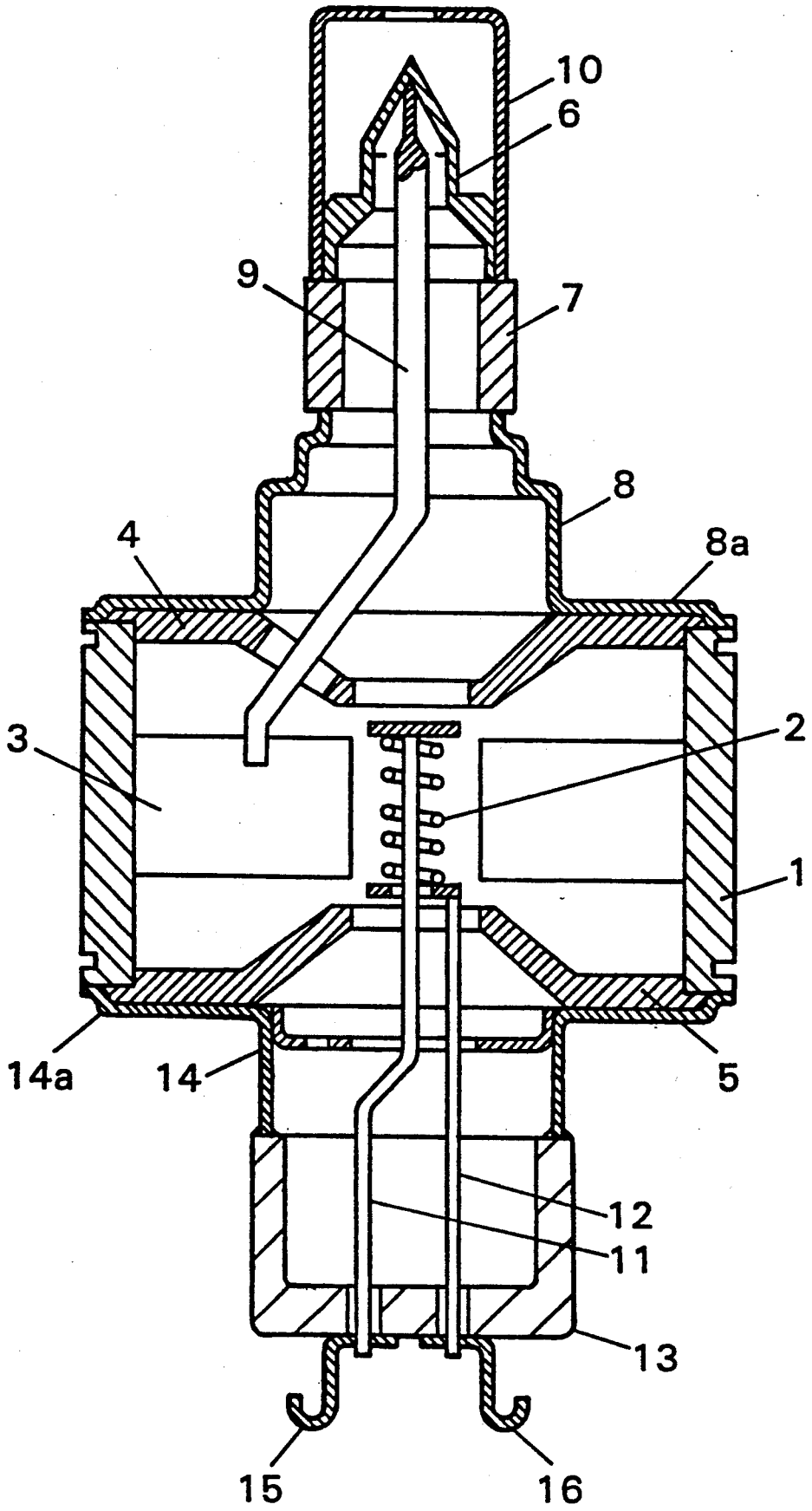
FIG. 19 is a sectional side view showing a conventional magnetron.

FIG. 1 shows a magnetron of this invention, which is different from the conventional magnetron shown in FIG. 19 only in that the neck portion of the eyelet-shaped metal tube 14 of this invention is provided with a circular metal piece 17 that surrounds the cathode supporting bars 11 and 12. However, as shown in FIG. 2, the metal piece 17 has a semicircular slot 18. The slot 18 has an electrical length that corresponds, for example, to about ½ or about ¼ of the wavelength of the fundamental components of the oscillating microwaves. This electrical length is slightly affected by the central hole 19 of the metal piece 17, but a microstrip-line-type choke is formed by this construction, and thus, the fundamental components of leaking microwaves decay or are reflected by resonance at the slot 18.

Figure 3:
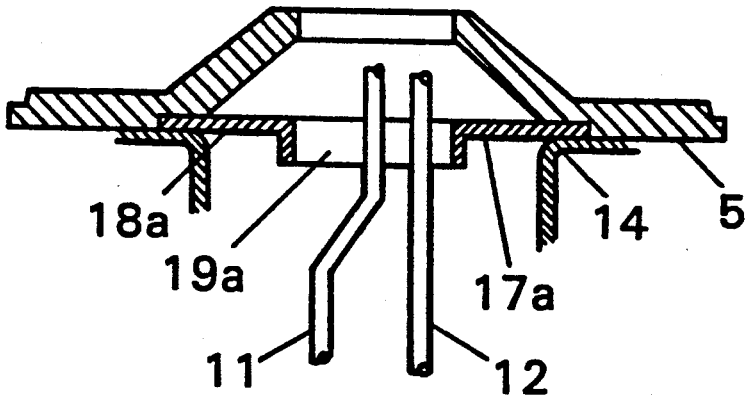
FIG. 3 is a sectional side view showing a portion of another magnetron of this invention.
Figure 4:
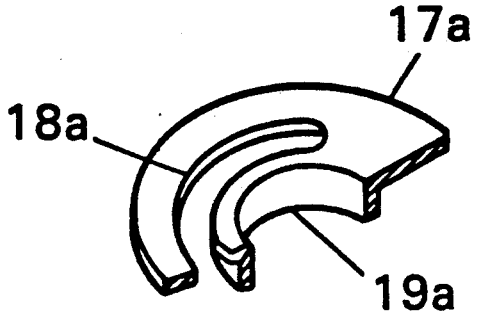
FIG. 4 is a perspective view showing a portion of the circular metal piece of the magnetron shown in FIG. 3.

FIG. 3 shows another magnetron of this invention, which is different from the conventional magnetron shown in FIG. 19 only in that the neck portion of the eyelet-shaped metal tube 14 of this invention is provided with a circular metal piece **17*a* with a slot 18*a* and a central hole 19*a* (FIG. 4). The metal piece 17*a* is held between the magnetic pole piece 5 and the metal tube 14. The metal piece 17*a* or 17 can also be soldered to the surface (metallized surface) of the stem insulator 13 that seals the metal tube 14. It is also possible for the metal piece 17 or 17*a* to be formed inside of the metal tube 14 in one piece with it. It is also possible to provide a number of pieces like the metal piece 17 or 17*a***.

Figure 5:
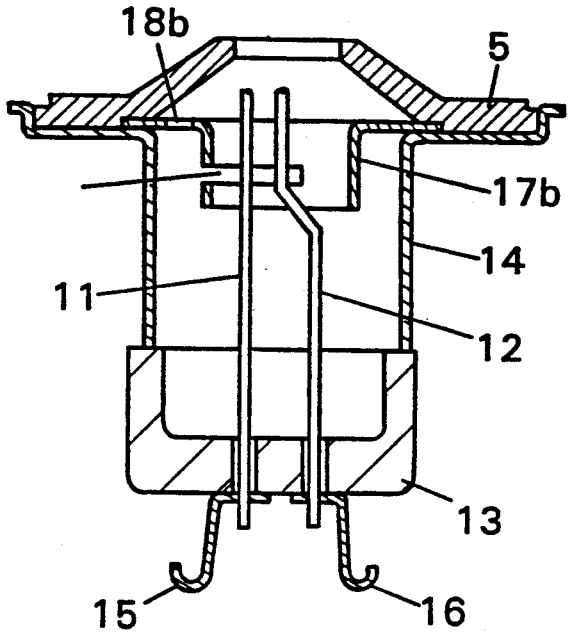
FIG. 5 is a sectional side view showing a portion of another magnetron of this invention.
Figure 6:
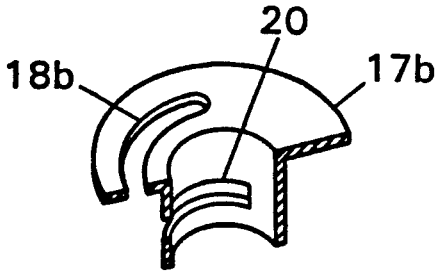
FIG. 6 is a perspective view showing a portion of the circular metal piece of the magnetron shown in FIG. 5.

FIG. 5 shows another magnetron of this invention, which is different from the conventional magnetron shown in FIG. 19 only in that the neck portion of the eyelet-shaped metal tube 14 of this invention is provided with an eyelet-shaped metal piece **17*b* that has a slot 18*b* in its flange portion and a slot 20 in its central cylindrical portion (FIG. 6). The slots 18*b* and 20** have an electrical length corresponding to about ¼ or ½ of the wavelength of the fundamental components or any of the harmonic components.

Figure 8:
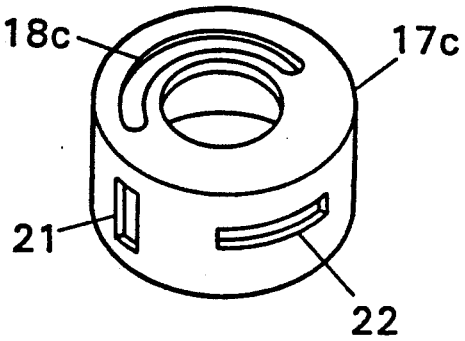
FIG. 8 is a perspective view showing the circular metal piece of the magnetron shown in FIG. 7.
Figure 7:
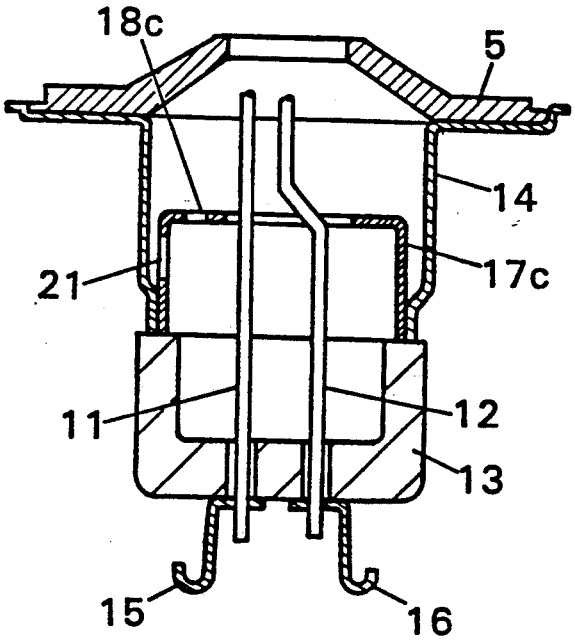
FIG. 7 is a sectional side view showing a portion of another magnetron of this invention.

FIG. 7 shows another magnetron of this invention, which is different from the conventional magnetron shown in FIG. 19 only in that the neck portion of the eyelet-shaped metal tube 14 of this invention is provided with a circular metal piece **17*c* that has a slot 18*c* in its top plate, and a number of slots 21 and 22 in its side surface (FIG. 8). The slots 18*c*, 21, and 22 have an electrical length selected in the same way as for the slots 18*b* and 20 shown in FIG. 6**.

Figure 9:
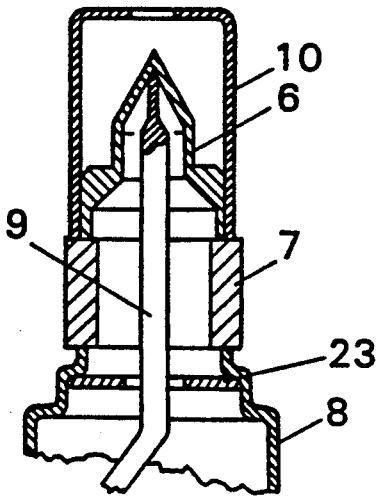
FIG. 9 is a sectional side view showing a portion of another magnetron of this invention.
Figure 10:
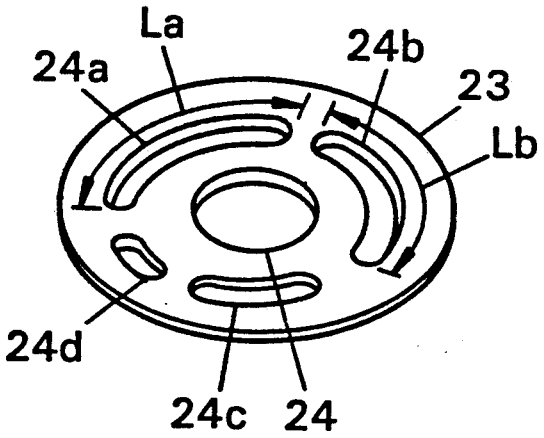
FIG. 10 is a perspective view showing the circular metal piece of the magnetron shown in FIG. 9.

FIG. 9 shows another magnetron of this invention, which is different from the conventional magnetron shown in FIG. 19 only in that a circular metal piece 23 that surrounds the microwave output conductor 9 is disposed at the neck portion of the eyelet-shaped metal tube 8 and moreover the said metal piece 23 has, as shown in FIG. 10, four slots **24*a*, 24*b*, 24*c*, and 24*d*. The slot 24*a* has an electrical length La that corresponds, for example, to about ¼ of the wavelength of the secondary harmonic components; the slot 24*b* has an electrical length Lb that corresponds, for example, to about ¼ of the wavelength of the tertiary harmonic components; in this way, each slot has an electrical length that corresponds to about ¼ of the wavelength of different harmonic components. These electrical lengths are slightly affected by the central hole 24 of the metal piece 23**, but a number of microstrip-line-type chokes are formed by this construction.

There can be more than one metal piece 23. In the magnetron of this invention shown in FIG. 11, the surface of the smaller end of the eyelet-shaped metal tube 25 constitutes a circular metal piece 25*a*, and as shown in FIG. 12, the metal piece 25*a* has a central hole 26 and an appropriate number of slots 26*a* and 26*b*.

Figure 11:
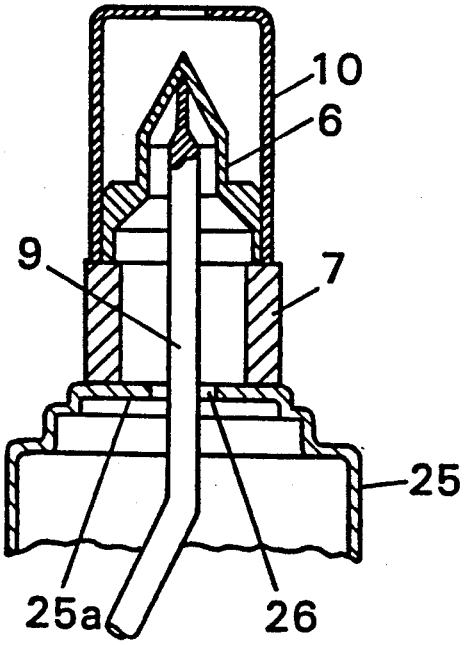
FIG. 11 is a sectional side view showing a portion of another magnetron of this invention.
Figure 12:
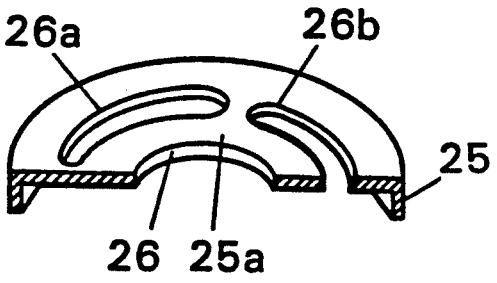
FIG. 12 is a perspective view showing a portion of the circular metal piece of the magnetron shown in FIG. 11.
Figure 13:
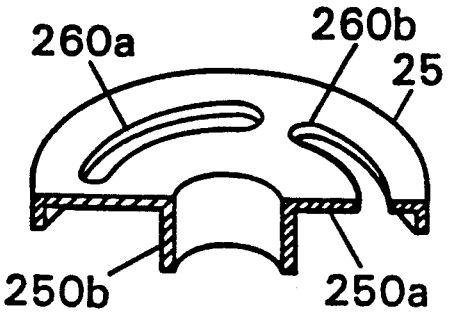
FIG. 13 is a perspective view showing a portion of another circular metal piece of the magnetron shown in FIG. 11.

FIG. 13 shows another circular metal piece 250*a* that is used in the magnetron of FIG. 11, instead of the circular metal piece 25*a*. The circular metal piece 250*a* has a cylindrical part 250*b* and an appropriate member of slots 260*a* and 260*b*. The cylindrical part 250*b* that constitutes a central hole of the metal piece 250*a* has an electrical length that is about ¼ of the wavelength of any of the harmonic waves, resulting in a choke to stop the radiation of the said harmonic waves.

In the magnetrons of this invention constructed in this way, the metal piece 23, 25*a*, or 250*a* can reduce by about 40 dB either one kind or a number of kinds of harmonic components. When a number of such metal pieces are provided in step fashion, it is possible to decrease yet larger amounts of harmonic components. It is also possible for the electrical length of each slot to be the same.

Figure 15:
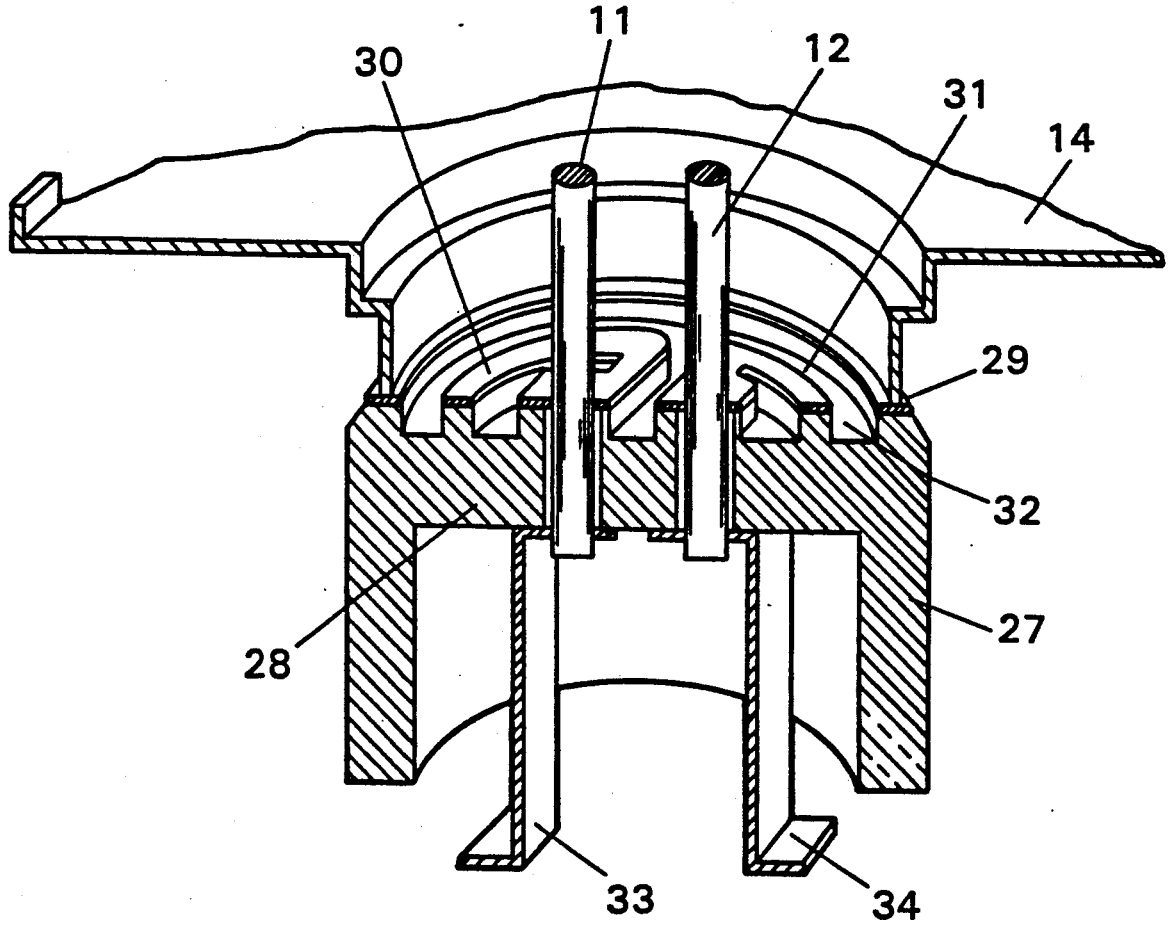
FIG. 15 is a perspective view showing a portion of the magnetron shown in FIG. 14.
Figure 14:
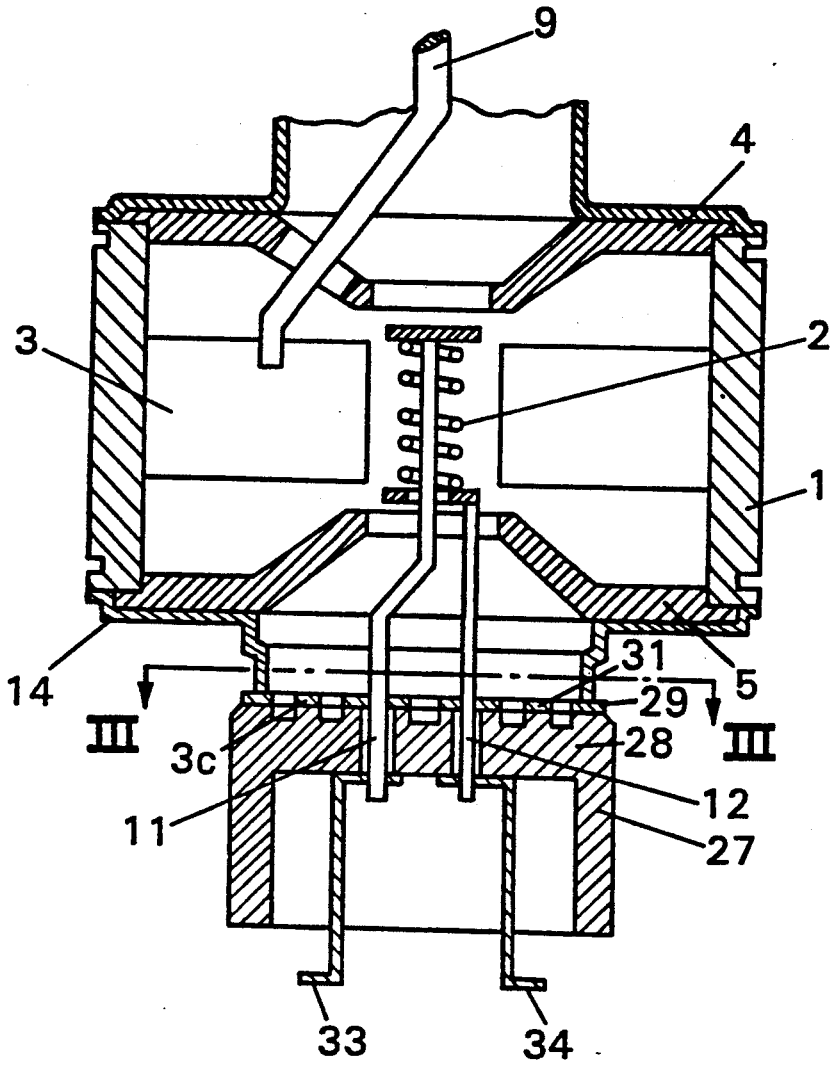
FIG. 14 is a sectional side view showing a portion of another magnetron of this invention.
Figure 16:
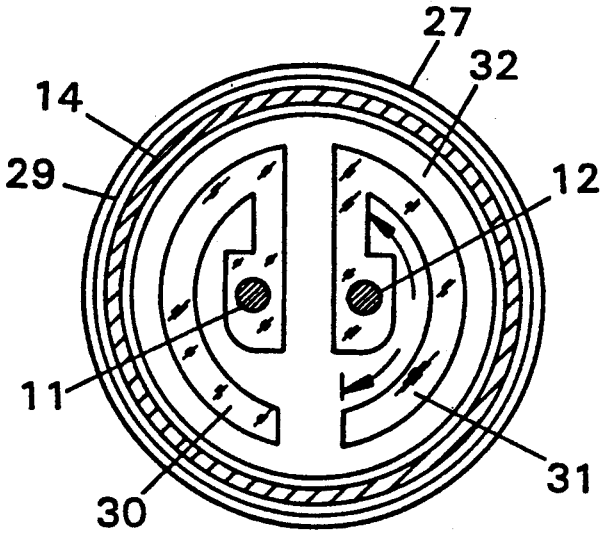
FIG. 16 is a sectional view of the magnetron taken along line III-III of FIG. 14.

FIG. 14 shows another magnetron of this invention, which is different from the conventional magnetron shown in FIG. 19 in that the magnetron of this invention comprises a ceramic stem insulator 27 with a cross-sectional shape of a reversed U and a disc-shaped conductive film 29 that is disposed on the disc-shaped portion 28 of the ceramic stem insulator 27. An eyelet-shaped metal tube 14 seals the opening of one end of the anode cylinder 1 by means of the flange of the metal tube 14. The disc-shaped conductive film 29 is soldered so as to be air-tight onto the surface of the smaller end of the metal tube 14. The disc-shaped portion 28 has holes through which the first and second cathode supporting bars 11 and 12 penetrate, and also has, on the inside of the tube 14, a pair of long, thin conductive films 30 and 31 that are prepared by a metallizing treatment in the same way as the conductive film 29. Conductive films 30 and 31 are soldered to the cathode supporting bars 11 and 12, respectively, so as to be air-tight, and in the case of a magnetron that has a microwave oscillation the fundamental wave of which is, for example, at 2450 MHz, these conductive films 30 and 31 have an electrical length L of about 15 mm, which is ¼ of the wavelength (about 62 mm) of the secondary harmonic components. The conductive films 29, 30, and 31 are placed in the same plane, and a groove 32 is formed in a region that they do not occupy (FIGS. 15 and 16).

With this construction, the secondary harmonic components that leak the propagation path of the cathode supporting bars 11 and 12 resonate within a choke that is formed by the conductive films 30 and 31, so that leakage of the said harmonic components to the outside of the tube can be prevented. When an Lc filter circuit of the well-known type is connected to the cathode terminals 33 and 34, and then they are enclosed by a shielding case, leakage of the fundamental components or the like to the outside of the apparatus can, of course, be prevented. Moreover, when at least one of the two conductive films 30 and 31 forms a choke the electrical length of which is ¼ of the wavelength of the fundamental wave or ¼ of the wavelength of the tertiary harmonic waves, it is possible to prevent leakage of the fundamental components or the tertiary harmonic components to the outside of the tube.

Figure 17:
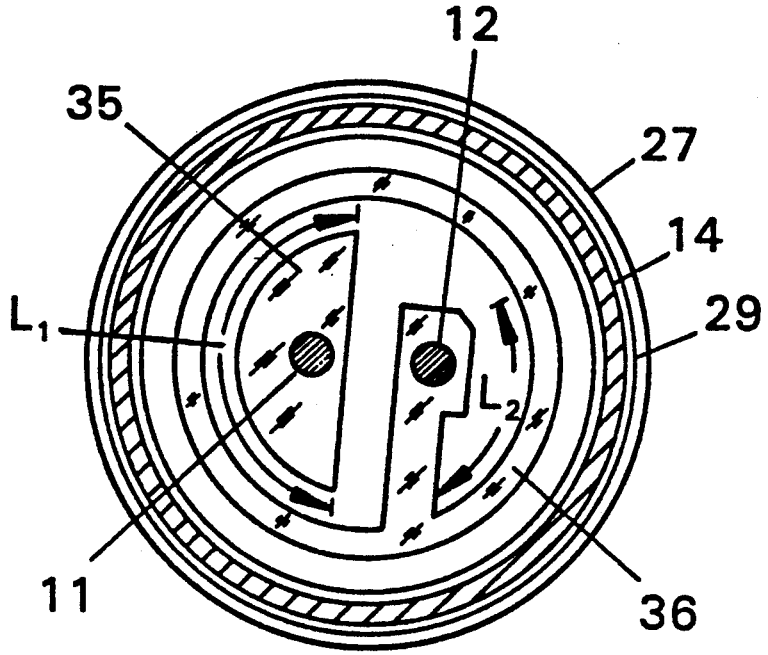
FIGS. 17 and 18 are cross-sectional views each showing another magnetron of this invention.

FIG. 17 shows another magnetron of this invention, in which a semicircular conductive film 35 is connected to the cathode supporting bar 11, and a conductive film 36 shaped like the letter $\theta$ is connected to the cathode supporting bar 12; in this way, two chokes with the electrical length of $L_1$, and $L_2$ are formed. In this case, as well, by the formation of chokes the $L_1$ and $L_2$ of which are each of an appropriate electrical length (that is, their electrical length is about ¼ of the wavelength of the fundamental components or any of the harmonic components), it is possible to prevent leakage of microwaves to the outside of the tube in the same way as mentioned before.

Figure 18:
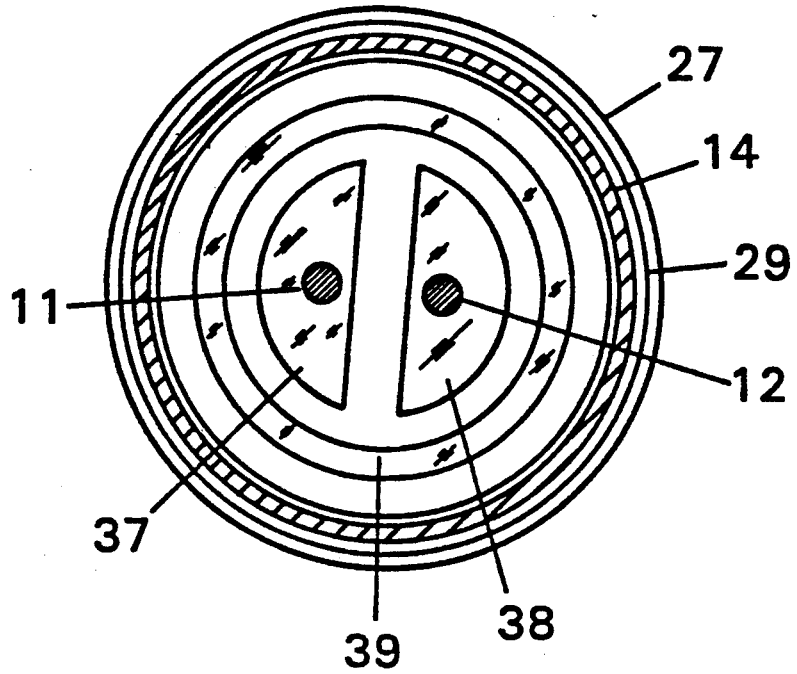

FIG. 18 shows another magnetron of this invention, which comprises semicircular conductive films 37 and 38 and a circular conductive film 39 that surrounds these films 37 and 38. In this case, as well, the construction of chokes with the electrical length set as described above makes it possible to prevent leakage of leaking microwaves of the desired wavelength to the outside of the tube.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

We claim:

1. A magnetron comprising an anode cylinder, a cathode that is disposed within said anode cylinder, a pair of magnetic pole pieces that are disposed one each over the openings of both ends of said anode cylinder, a stem insulator that seals the openings of one end of said anode cylinder so as to cover said magnetic pole piece at the opening of the end of said anode cylinder with a metal tube, and a pair of cathode supporting bars that pass through said stem insulator in an air tight fashion, wherein said metal tube is provided with a circular metal piece surrounding said cathode supporting bas and said metal piece is provided with a slot for the decay or reflection of fundamental components or any of the harmonic components of oscillating microwaves, said slot has an electrical length that corresponds to about ¼ or ½ of the wavelength of said fundamental components or any of the harmonic components of oscillating microwaves.

2. A magnetron according to claim 1, wherein the edge of said circular metal piece is held between said magnetic pole piece and said metal tube.

3. A magnetron according to claim 1, wherein said metal piece is an eyelet-shaped metal piece, the flange of which is provided with said slot.

4. A magnetron according to claim 1, wherein said metal piece is an eyelet-shaped metal piece, the cylindrical portion of which is provided with said slot.

5. A magnetron comprising an anode cylinder, a cathode that is disposed within said anode cylinder, a metal sleeve that seals the opening of one end of said anode cylinder by means of a metal tube and an insulating tube, and a microwave output conductor that extends from anode vanes that project toward said cathode from the inside surface of said anode cylinder, said microwave output conductor being connected to said metal sleeve, wherein said metal tube is provided with a circular metal piece that surrounds said microwave output conductor and said metal piece is provided with a slot in which any of the harmonic components of oscillating microwaves resonate, said slot has an electrical length that corresponds to about ¼ or ½ of the wavelength of any of said harmonic components.

6. A magnetron according to claim 5, wherein said slot is formed into an arc of the circle along the circumference of said circular metal piece.

7. A magnetron according to claim 6, wherein said slot is constituted by a plurality of arc-shaped slots that have different electrical lengths.

8. A magnetron according to claim 5, wherein said metal piece is incorporated with said metal tube into one piece.

9. A magnetron comprising an anode cylinder, a cathode that is disposed within said anode cylinder, a pair of cathode supporting bars, and a stem insulator that seals the opening of one end of said anode cylinder by means of metal tube, said stem insulator having a disc-shaped portion through which said cathode supporting bars pass and said disc-shaped portion of said stem insulator having a circular conductive film that seals the space between the circular portion of said stem insulator and said metal tube, wherein a conductive film is disposed on said disc-shaped portion of said stem insulator, resulting in a choke at which the fundamental components or any of the harmonic components of oscillating microwaves resonate, said choke having an electrical length that corresponds to about ¼ or ½ of the wavelength of the fundamental wave or the tertiary harmonic waves, and said conductive film is connected to said cathode supporting bars.

* * * * *

UNITED STATES PATENT AND TRADEMARK OFFICE

CERTIFICATE OF CORRECTION

PATENT NO. : 5,021,713

DATED : June 4, 1991

INVENTOR(S) : Kaoru Uesawa et al.

It is certified that error appears in the above-identified patent and that said Letters Patent is hereby corrected as shown below:

In the Drawings:

Fig. 5, insert the reference numeral 20 at the lead line between the reference numerals 18b and 11.

Signed and Sealed this

Twenty-second Day of September, 1992

*Attest:*

DOUGLAS B. COMER

*Attesting Officer*

*Acting Commissioner of Patents and Trademarks*